US005421575A

United States Patent [19]

Triner

[11] Patent Number: 5,421,575

[45] Date of Patent: Jun. 6, 1995

[54] BALL GAME TOY

[76] Inventor: Robert D. Triner, 5294 Bridge Creek Ave., Canton, Ohio 44718

[21] Appl. No.: 237,389

[22] Filed: May 3, 1994

[51] Int. Cl.[6] ..... A63F 7/02
[52] U.S. Cl. ..... 273/109
[58] Field of Search ..... 273/109-117, 273/241

[56] References Cited

U.S. PATENT DOCUMENTS

| | | | |
|---|---|---|---|
| 772,281 | 10/1904 | Jurado | 273/109 X |
| 1,899,833 | 2/1933 | Strobel | 273/109 |
| 2,961,796 | 11/1960 | Davis | 273/109 |
| 3,135,512 | 6/1964 | Taylor | 273/109 |
| 3,406,971 | 10/1968 | Koff | 273/109 |
| 3,627,316 | 12/1972 | Machinski | 273/109 X |
| 4,394,016 | 7/1983 | Manos | 273/109 |
| 4,726,588 | 2/1988 | Caprio | 273/109 X |
| 4,759,547 | 7/1988 | Shin-Tao | 273/109 |
| 4,772,240 | 9/1988 | Boskovic | 273/109 X |
| 5,316,307 | 5/1994 | Kersh | 273/241 |

FOREIGN PATENT DOCUMENTS

| | | | |
|---|---|---|---|
| 5184 | of 1909 | United Kingdom | 273/109 |
| 752110 | 7/1956 | United Kingdom | 273/109 |
| 2211099 | 6/1989 | United Kingdom | 273/109 |

OTHER PUBLICATIONS

Tarrson's "3-in-1" Puzzle Ball, *Playthings*, Mar. 1954, p. 682.

Tumble Tower, *Playthings*, Nov. 1971, 1 page.

*Primary Examiner*—William E. Stoll
*Attorney, Agent, or Firm*—Hawes & Fischer

[57] ABSTRACT

A ball game toy having top and bottom end caps and a cylindrical body extending therebetween. A control rod extends longitudinally through the body and outwardly of the top and bottom end caps to permit the toy to be manually manipulated by a user to correspondingly control the movement of a ball. The control rod supports a longitudinally extending stack of disk-like platforms in spaced coaxial alignment with the cylindrical body. Each platform has a hole formed therethrough to establish a drop path from the first to the last platform of the stack. A fall path is established in the space between the stack of platforms and the cylindrical body. Play is successfully concluded when the ball completes the drop path through the holes formed in the stack of platforms for receipt by a catch located below the hole in the last platform. Play is prematurely interrupted in the event that the ball inadvertently rolls off a platform of the stack and falls, under the influence of gravity, into the bottom end cap by way of the fall path.

10 Claims, 4 Drawing Sheets

BALL GAME TOY

BACKGROUND OF THE INVENTION

1. Field of the Invention

This invention relates to a game of skill which tests the manual dexterity of the user in moving a ball along a drop path and through a series of holes formed in respective spaced, parallel aligned platforms without the ball rolling off a platform and prematurely interrupting play.

2. Background Art

Ball game toys are well known to adults and children, alike. Typically, the toy is manually manipulated by the user to move a ball into a hole that is formed in a single planer playing surface. Many of these games are often played quickly and require a relatively low level of skill. It would therefore be desirable to have available a ball game toy to be played by both adults and children that will require a great deal of skill and typically consume a large amount of time to successfully complete. Rather than merely locating a ball within a hole in a single playing surface, the ball of the new toy must be moved through a series of holes in successive playing surfaces stacked one above the other. The failure of the user to move the ball from one playing surface to the next will result in the ball rolling off the stack of playing surfaces thereby requiring that the game be restarted anew.

SUMMARY OF THE INVENTION

In general terms, a ball game toy is disclosed having top and bottom end caps and a hollow, cylindrical body extending therebetween. A control rod extends longitudinally through the body and outwardly from the top and bottom ends. A finger control ball is located at each end of the control rod to facilitate manipulation of the toy by the user so that the corresponding movement of a ball may be controlled. The control rod supports a stack of disk-like platforms that are retained in spaced, parallel alignment with one another through the housing. Each platform of the stack has a hole formed therethrough to establish a drop path from the first platform to the last. Each platform also has a guide rail located diametrically opposite the hole so as to prevent the ball from rolling off the platform. The stack of platforms is spaced radially inward from the cylindrical body to establish a fall path between the stack and the body.

During play, the user tilts and rotates the toy by means of the finger control balls in an effort to maneuver the ball along the drop path and through each of the holes formed in the stack of platforms. Play is successfully concluded when the ball is received by a catch located below the hole formed through the last platform of the stack. However, play is prematurely interrupted in the event that the ball rolls off a platform of the stack and falls, under the influence of gravity, along the drop path into the bottom end cap. In this case, play may be resumed (i.e. started anew) by returning the ball to a starting disk located in the housing above the stack of platforms.

DETAILED DESCRIPTION

Figure 1:
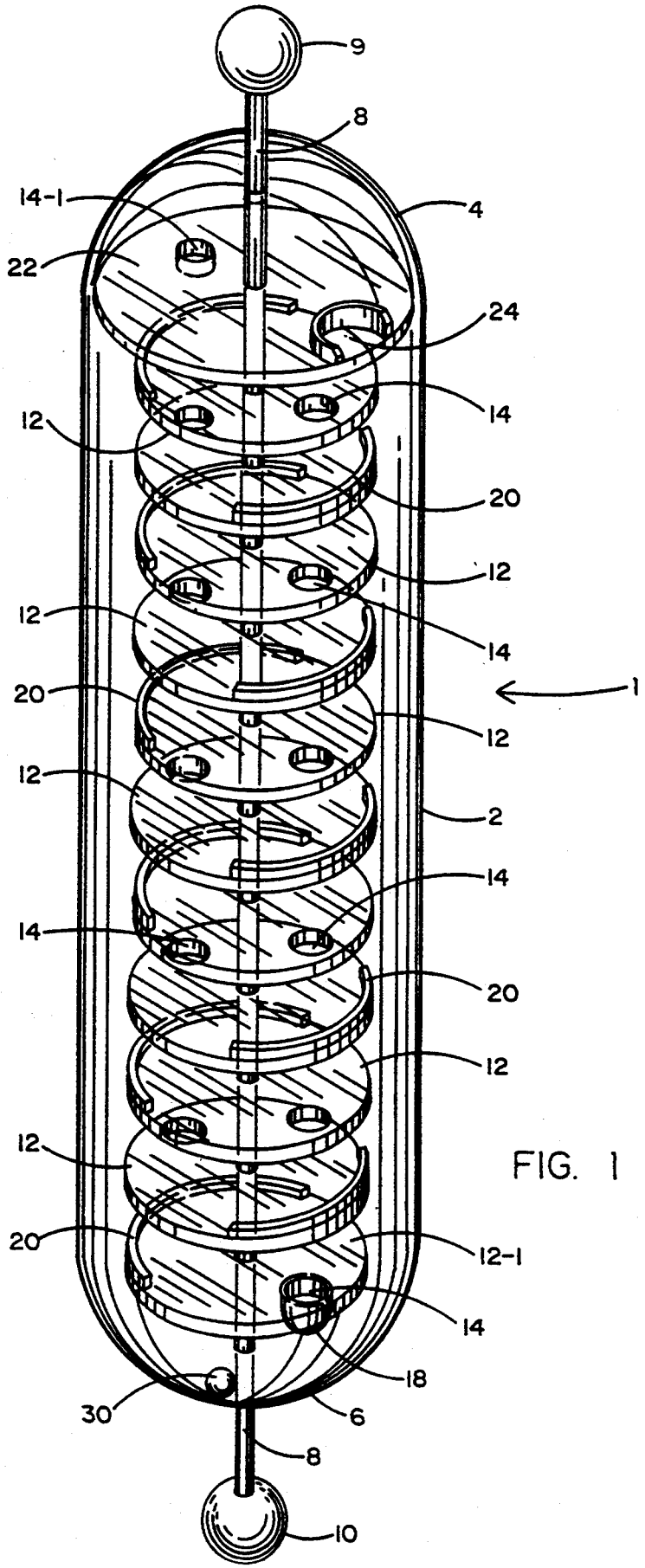
FIG. 1 is a perspective view of the ball game toy which forms the present invention.

Details of the ball game toy 1 which form this invention are now disclosed when referring concurrently to FIGS. 1–6 of the drawings. The toy 1 includes a cylindrical body 2 having a hemispherically shaped cap 4 and 6 secured to each end thereof. The body 2 and end caps 4 and 6 are manufactured from a transparent, impact resistant material, such as clear plastic, or the like. An elongated control rod 8 extends longitudinally through the toy 1 in coaxial alignment with the cylindrical body 2. A finger control ball 9 and 10 is located at each end of the control rod 8 to permit the user to grasp the control rod and thereby manipulate the toy 1 in a manner that will be described in greater detail hereinafter.

Figure 2:
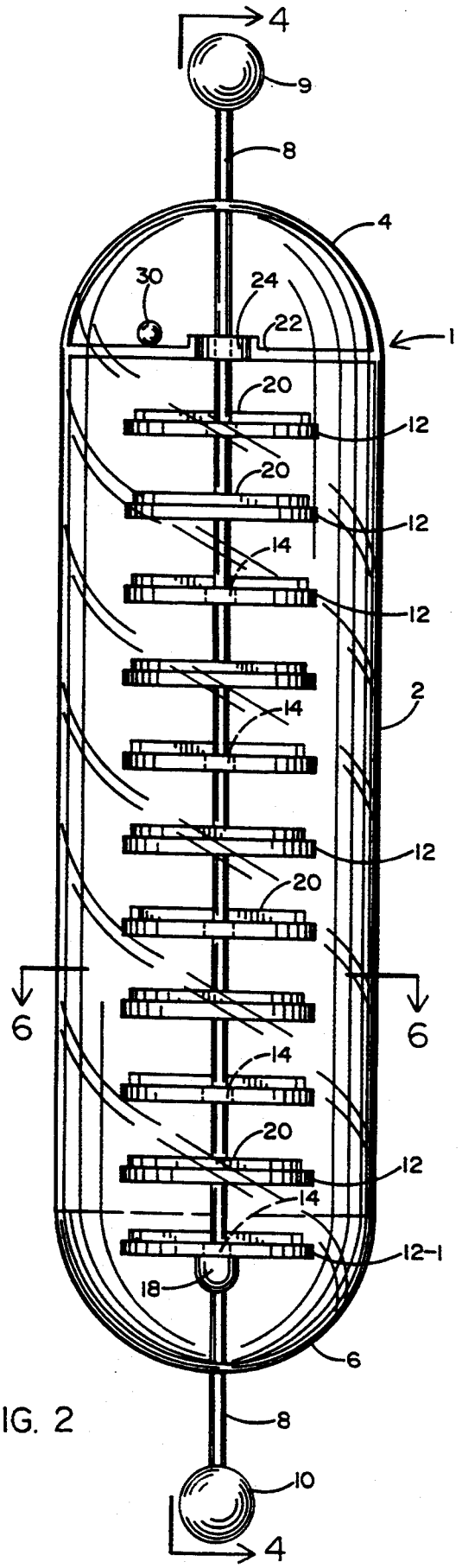
FIG. 2 is a front elevation of the ball game toy of FIG. 1.
Figure 3:
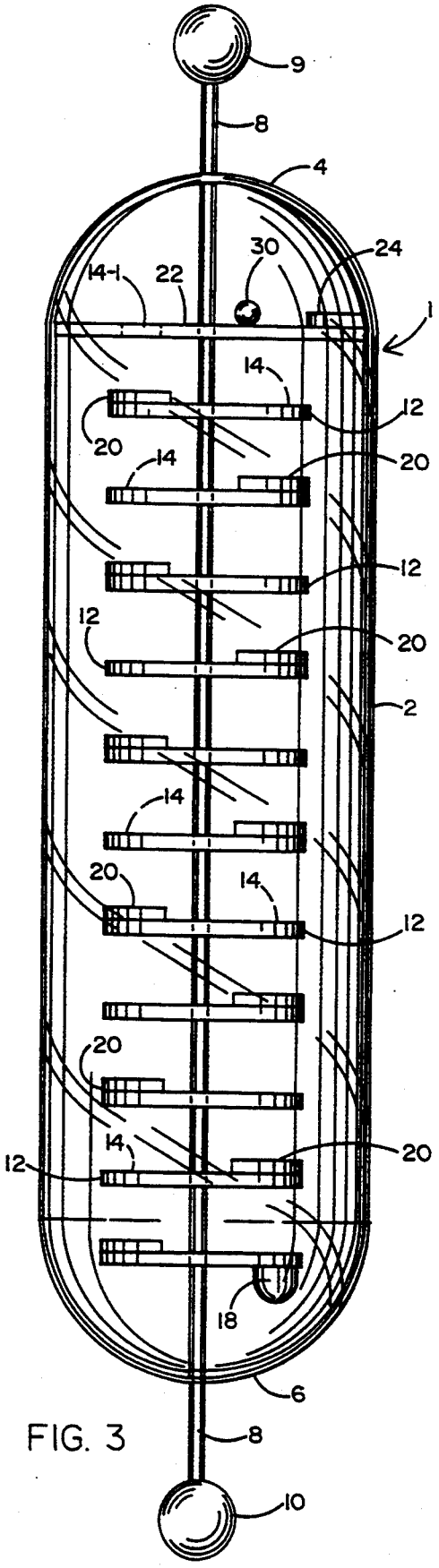
FIG. 3 is a side elevation of the ball game toy of FIG. 1.

A vertical (i.e. longitudinally extending) stack of disk-like platforms 12 are supported in spaced parallel alignment with one another along the control rod 8 at the interior of cylindrical body 2. As is best shown in FIGS. 2 and 3, the stack of platforms 12 is spaced radially inward from the cylindrical body 2. In the embodiment illustrated, the control rod 8 supports a stack of eleven platforms 12. While the number of platforms 12 carried on control rod 8 within cylindrical body 2 determine the skill required to successfully play the ball game toy 1, it is to be expressly understood that the precise number of platforms 12 is not to be regarded as a limitation of the present invention.

Each disk-like platform 12 has a round hole 14 extending therethrough. To increase the difficulty in playing the toy, the location of the holes 14 in successive platforms 12 alternates between diametrically opposite positions. In this regard, the series of holes 14 from one platform 12 of the stack to the next platform therebelow forms a drop path (best illustrated in FIG. 4 and designated by the reference numeral 16). In the case of the last or bottom platform 12-1 of the stack, a catch 18 (also best shown in FIG. 4) is secured (e.g. glued) immediately below the hole 14 therethrough. The catch 18 receives a ball 30 that has completed the drop path 16 and fallen through each of the holes 14 in platforms 12 and 12-1, whereby to successfully conclude the game.

To assist the player in maneuvering the ball 30 through the holes 14 of platforms 12 and along the drop path 16, an arcuate guide rail 20 is disposed circumferentially around a portion of each disk-like platform 12 of the stack. Each guide rail 20 is located diametrically opposite the hole 14 formed through each platform 12, such that the positions of the rails 20 alternate from one platform 12 to the next. The guide rails 20 function to intercept and block the ball 30 from inadvertently rolling off a platform 12 of the stack and falling downwardly along a fall path (best illustrated in FIG. 4 and designated by the reference numeral 26) established in the space between the platforms 12 and the cylindrical body 2 of the toy 1. In this case, the ball 30 will fall under the influence of gravity to the bottom end cap 6 (best shown in FIG. 1).

Extending laterally and completely across the ball game toy 1 above the stack of platforms 12 at the interface of the top end cap 4 with the body 2 is a starting disk 22. The starting disk 22 has a hole 14-1 formed therethrough similar to the holes 14 formed through respective disk-like platforms 12 of the stack of platforms located below starting disk 22. Located diametrically opposite the opening 14-1 through starting disk 22 is an entry port 24. The purpose of entry port 24 is to provide an access opening to permit the ball 30 which has rolled off a platform 12 and moved along the fall path 26 (of FIG. 4) to the bottom end cap 6 to be returned to the starting disk 22 by way of a return path (best illustrated in FIG. 4 and designated by the reference numeral 28) established in the space between the stack of platforms 12 and the cylindrical body 2. In this regard, it will be necessary to turn the ball game toy 1 upside down so that the ball 30 will fall through the entry port 24. When the toy is turned over again, the ball 30 is free to roll along the starting disk 22 above the stack of platforms 12 until play begins anew.

It may be appreciated that the aforementioned fall path 26 and return path 28 (of FIG. 4) are established in the same space between the stack of disk-like platforms 12 and the cylindrical body 2 of toy 1. However, it should be similarly recognized that the ball 30 will move in a first (e.g. downward) direction along the fall path 26 after rolling off a platform 12 to end play and in an opposite (e.g. upward) direction along the return path 28 for receipt through the entry port 24 to restart play.

More particularly, play begins when the ball 30 drops through the hole 14-1 in the starting disk 14-1 to be received by the first platform 12 of the stack of platforms located below disk 14-1. The object of the ball game toy 1 of this invention is for the player to exercise skill and manual dexterity to carefully roll the ball 30 around each of the disk-like platforms 12 so that the ball 30 will eventually fall through each of the holes 14 in successive platforms 12. To this end, the user grasps the finger control balls 9 and 10 at the ends of the control rod 8 in order to manipulate (e.g. rotate or tilt) the toy 1 so that the ball 30 completes the drop path 16 (of FIG. 4) through the holes 14 in successive platforms 12 of the stack until the ball 30 is safely received within the catch 18 at the last platform 12-1. Play is concluded when the ball is moved from the starting disk 22 to the catch 18 without rolling off any of the platforms 12 or 12-1 therebetween.

Figure 4:
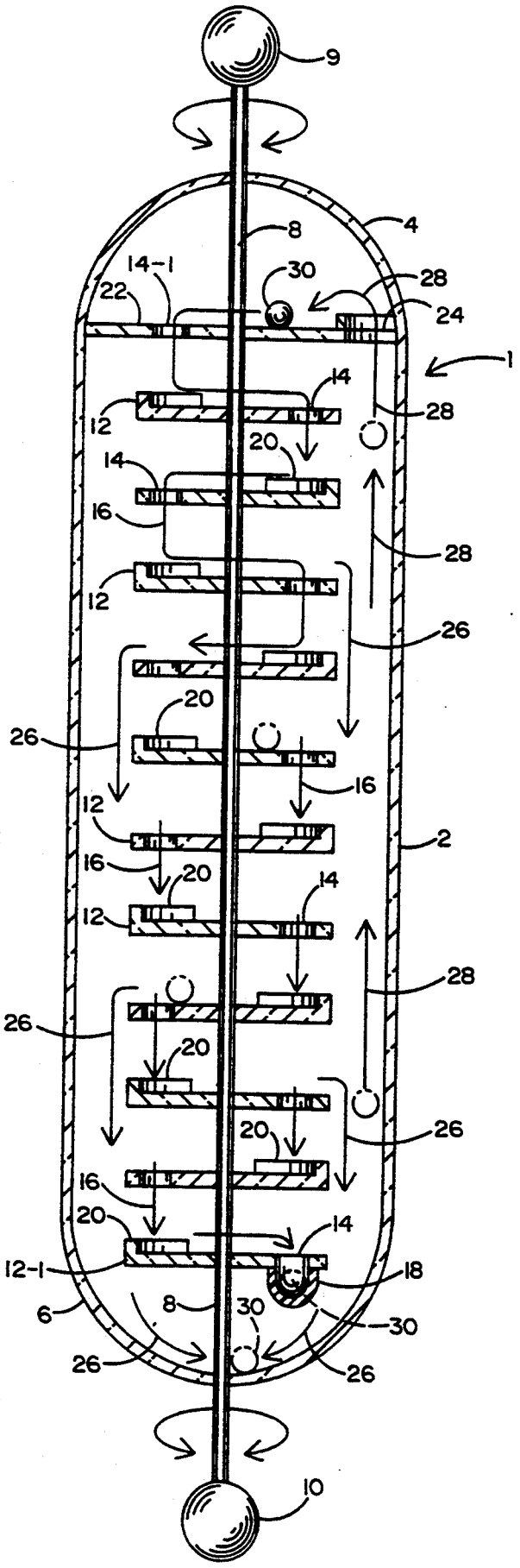
FIG. 4 is a cross-section of the toy taken along lines 4—4 of FIG. 2.
Figure 5:
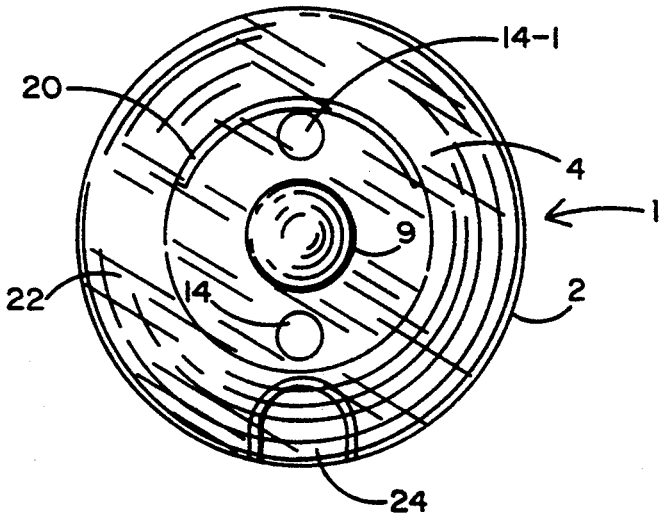
FIG. 5 is a top plan view of the ball game toy of FIG. 1.
Figure 6:
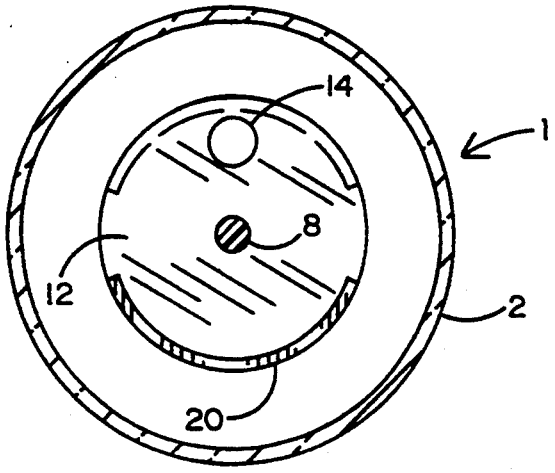
FIG. 6 is a cross-section of the ball game toy taken along lines 6—6 of FIG. 2.

Although the guide rails 20 can be used to the advantage of the player to prevent the ball 30 from rolling off the platforms 12, play will be prematurely interrupted in the event that the ball 30 moves out of the drop path 16 and rolls into the fall path 26 (of FIG. 4). In this case, the ball 30 will fall downwardly past the stack of platforms 12 to the bottom end cap 6. Play may resume and start anew in the manner described above by returning the ball 30 to the starting disk 22 via the return path 28 and the entry port 24.

It will be apparent that while a preferred embodiment of the invention has been shown and described, various modifications and changes may be made without departing from the true spirit and scope of the invention.

Having thus set forth the preferred embodiment, what is claimed is:

1. A ball game toy having a longitudinally extending axis and comprising:

a ball;

a longitudinally extending stack of platforms, each of the platforms of said stack being arranged in spaced parallel alignment with one another;

a hole formed through each platform of said stack, the holes of said platforms cooperating with one another to form a drop path so that said ball drops from one of said platforms to the next;

a top end cap;

a bottom end cap; and a body positioned between said top and said bottom end caps, said stack of platforms extending longitudinally between said top and bottom end caps and spaced inwardly from said body to establish a fall path between said platforms and said body along which said ball falls under the influence of gravity when said ball rolls off one of said platforms.

2. The ball game toy recited in claim 1, further comprising a catch located below the hole formed through the last platform of said stack, said catch receiving the ball after said ball drops through each of said holes formed in each of said platforms.

3. The ball game toy recited in claim 1, wherein each platform of said stack of platforms is a disk.

4. The ball game toy recited in claim 3, wherein the hole formed through one of the platforms of said stack is aligned diametrically opposite the hole formed through the next platform of said stack.

5. The ball game toy recited in claim 3, wherein each platform of said stack has a guide rail extending around at least some of the periphery of said platform to prevent said ball from rolling off said platform and into said fall path.

6. The ball game toy recited in claim 5, wherein the guide rails of respective platforms of said stack are aligned diametrically opposite the holes formed through said platforms.

7. The ball game toy recited in claim 1, further comprising a control rod extending longitudinally through said body between said top and bottom end caps, said control rod supporting said stack of platforms so as to be spaced inwardly of said body.

8. The ball game toy recited in claim 7, wherein said longitudinally extending control rod projects outwardly from each of said top and bottom end caps, said toy further comprising a finger control ball located on each of the outwardly projecting ends of said control rod by which to permit said game to be manually manipulated and said ball to be moved along said drop path through said stack of platforms.

9. The ball game toy recited in claim 1, further comprising a starting platform extending laterally and completely across said body above said stack of platforms to initially receive said ball thereon, said starting platform having a hole formed therethrough through which said ball falls to be received by one of said platforms of said stack of platforms.

10. The ball game toy recited in claim 9, further comprising an entry port formed through said starting platform, the ball being returned to said starting platform by way of said entry port after said ball has completed said drop path or said fall path.

* * * * *